US011375860B2

(12) United States Patent
Ford

(10) Patent No.: US 11,375,860 B2
(45) Date of Patent: Jul. 5, 2022

(54) STACK OF INTERLEAVED WIPES

(71) Applicant: Nice-Pak International Limited, Flint Clwyd (GB)

(72) Inventor: Simon Ford, Wirral (GB)

(73) Assignee: Nice-Pak International Limited, Flint Clwyd (GB)

( * ) Notice: Subject to any disclaimer, the term of this patent is extended or adjusted under 35 U.S.C. 154(b) by 0 days.

(21) Appl. No.: 15/777,289

(22) PCT Filed: Nov. 18, 2016

(86) PCT No.: PCT/GB2016/053604
§ 371 (c)(1),
(2) Date: May 18, 2018

(87) PCT Pub. No.: WO2017/085506
PCT Pub. Date: May 26, 2017

(65) Prior Publication Data

US 2018/0333014 A1 Nov. 22, 2018

(30) Foreign Application Priority Data

Nov. 20, 2015 (GB) ..... 1520470

(51) Int. Cl.
*A47K 10/42* (2006.01)
*B65H 45/24* (2006.01)
*A47L 13/17* (2006.01)

(52) U.S. Cl.
CPC ..... *A47K 10/42* (2013.01); *A47L 13/17* (2013.01); *B65H 45/24* (2013.01); *A47K 2010/428* (2013.01)

(58) Field of Classification Search
CPC ..... A47K 10/42; A47K 10/421; A47K 2010/428; A47K 10/025; A47K 10/20;
(Continued)

(56) References Cited

U.S. PATENT DOCUMENTS 1,393,415 A * 10/1921 Wheeler ..... B65H 45/24 270/39.09
1,657,942 A * 1/1928 Spaldo ..... B65D 83/0847 206/216
(Continued)

FOREIGN PATENT DOCUMENTS

EP 0879575 B1 11/1998
EP 1 197 460 A2 4/2002
(Continued)

OTHER PUBLICATIONS

Examination Report, UK Intellectual Property Office, dated Aug. 26, 2020.
(Continued)

*Primary Examiner* — Rakesh Kumar
(74) *Attorney, Agent, or Firm* — Bay State IP, LLC

(57) ABSTRACT

A stack of interleaved wipes where the first wipe (10) will have its first crease (15) drawn to the region of or partially through an opening (1) in a container (2) of the wipes, so that it can be grasped and drawn through the opening. The second wipe (20) and those below are in their interleaved arrangement. The crease (25) together with adjoining parts of the portions (21, 24), is enfolded in a fold (170) of the wipe (10) formed by its portions (11, 16) and the crease (17). The wipe (10) is the wipe next to the wipe (20) on its side opposite from its portions (24, 26). The crease (27) at the opposite edge from crease (25) of the main portion (21) forms with the main portion (21) and the second folded portion (26) a fold (270) which enfolds the fold (350) of the wipe (30).

7 Claims, 8 Drawing Sheets

(58) Field of Classification Search
CPC .... A47K 10/24; A47K 10/3637; B65H 45/24; B65H 45/20; B65H 45/30; A47L 13/17
USPC ..... 221/63
See application file for complete search history.

(56) References Cited

U.S. PATENT DOCUMENTS 2,085,649 A * 6/1937 Gluck ..... B65D 83/0847 206/449
2,195,622 A * 4/1940 Fourness ..... B65D 83/0894 221/51
2,611,482 A * 9/1952 Nelson ..... B65D 83/0894 221/51
3,209,941 A * 10/1965 Krake ..... A47K 10/421 221/302
3,456,844 A * 7/1969 Planner ..... B65D 83/0847 221/63
3,482,734 A * 12/1969 Mierson ..... B65D 83/0811 229/242
3,612,264 A * 10/1971 Trunick ..... B65D 83/08 206/460
3,700,138 A * 10/1972 Nelson ..... A47K 10/42 206/451
3,896,966 A * 7/1975 Canno ..... B65D 83/0852 221/63
4,070,489 A * 1/1978 Pahnke ..... B65D 5/545 426/115
4,175,673 A * 11/1979 McDonald ..... B65D 5/54 221/63
4,638,921 A * 1/1987 Sigl ..... A47K 10/421 221/48
4,793,487 A * 12/1988 Bentsen ..... B65D 75/5888 206/451
5,219,092 A 6/1993 Morand
5,305,881 A * 4/1994 Caldwell ..... B65D 83/0088 229/230
5,310,057 A * 5/1994 Caldwell ..... B65D 83/0088 229/230
5,577,612 A * 11/1996 Chesson ..... B65D 83/0847 206/494
5,918,735 A * 7/1999 Bando ..... B65D 83/0805 53/381.2
6,030,331 A * 2/2000 Zander ..... A47K 10/421 493/356
6,045,002 A * 4/2000 Wierschke ..... B65H 45/24 221/48
6,202,845 B1 3/2001 Hill
6,213,344 B1 * 4/2001 Hill ..... A47K 10/42 221/197
6,213,345 B1 * 4/2001 Plank ..... B65D 83/0894 221/48
6,286,712 B1 * 9/2001 Craig ..... B65H 45/24 206/494
6,296,144 B1 * 10/2001 Tanaka ..... B65D 83/0894 221/45
6,363,851 B1 * 4/2002 Gerhard ..... B41F 17/02 270/1.03
6,550,634 B1 * 4/2003 Alegre De Miquel ..... B65D 83/0805 221/48
6,585,130 B2 * 7/2003 Turbett ..... A47K 10/424 221/45
6,901,718 B2 * 6/2005 Osborne ..... B65B 25/145 493/437
6,964,349 B2 * 11/2005 Sears ..... A47K 10/421 206/494
7,322,489 B2 * 1/2008 Long ..... B65H 45/24 221/38
7,568,594 B2 * 8/2009 Long ..... A47K 10/421 221/63
7,625,333 B2 * 12/2009 Yardley ..... A47G 11/001 493/405
7,762,426 B2 * 7/2010 Stevens ..... B65D 43/162 221/154
8,083,097 B2 * 12/2011 Kaufman ..... B65H 45/24 221/48
8,342,360 B2 * 1/2013 Long ..... B65D 83/0894 221/48
9,017,790 B2 * 4/2015 Mrvica ..... B65H 45/24 428/126
10,172,500 B2 * 1/2019 Mrvica ..... A61F 13/15747
2001/0020625 A1 * 9/2001 Angelis ..... B65D 83/0805 221/48
2002/0060222 A1 * 5/2002 Bando ..... A47K 10/421 221/48
2003/0062376 A1 * 4/2003 Sears ..... B65H 45/24 221/48
2004/0016211 A1 * 1/2004 Osborne ..... B65B 25/145 53/429
2005/0058807 A1 3/2005 Hochtritt et al.
2006/0102643 A1 * 5/2006 Kaufman ..... B65H 45/24 221/48
2006/0219731 A1 * 10/2006 Long ..... B65H 45/24 221/48
2006/0237474 A1 * 10/2006 Long ..... B65D 83/0894 221/33
2007/0062968 A1 * 3/2007 Mark ..... B65D 83/0894 221/48
2007/0215632 A1 * 9/2007 Bendor ..... A47K 10/42 221/63
2008/0054012 A1 3/2008 Long
2009/0190866 A1 * 7/2009 Hughes ..... B65D 75/5844 383/207
2010/0104799 A1 * 4/2010 Wunderlich ..... B65H 45/22 428/130
2014/0209625 A1 * 7/2014 White ..... A47K 10/421 221/63
2015/0335210 A1 * 11/2015 Denis ..... A47K 10/16 221/33
2016/0051099 A1 * 2/2016 White ..... B65D 83/08 206/494

FOREIGN PATENT DOCUMENTS

EP 1195333 A1 4/2002
EP 2 179 953 A1 4/2010
EP 2275015 A1 1/2011
WO 2005/102132 A1 11/2005

OTHER PUBLICATIONS

Examination Report, UK Intellectual Property Office, dated Mar. 29, 2021.
Search Report, UK Intellectual Property Office, dated May 11, 2017.

* cited by examiner

STACK OF INTERLEAVED WIPES

CROSS REFERENCE TO RELATED APPLICATION

This application is for entry into the U.S. National Phase under § 371 for International Application No. PCT/GB2016/053604 having an international filing date of Nov. 18, 2016, and from which priority is claimed under all applicable sections of Title 35 of the United States Code including, but not limited to, Sections 120, 363, and 365(c), and which in turn claims priority under 35 USC 119 to Great Britain Patent Application No. 1520470.4 filed on Nov. 20, 2015.

The present invention relates to a stack of interleaved wipes.

Wipes are flat sheets of material generally used for cleaning. Wipes may either be dry, or more commonly wet—impregnated with a liquid such as a cleansing agent which assists the cleaning action of the wipe. Wipes are often provided in stacks of wipes enclosed within a container, typically as a flow wrap pack. The container typically has an opening through which the wipes can be individually extracted.

Normally, the wipes are interleaved, by providing each wipe with a fold between two portions of it having a portion of the next wipe between them. This arrangement draws the portion of the next wipe to the opening when the first wipe is withdrawn through the opening. It should be noted that not every pair of wipe portions connected by a fold necessarily has a portion of the next wipe between them. The folds in the interleaved wipes are normally such that the wipes are folded back double against each other or the intervening portion of the next wipe. As such the term "fold" is used herein to mean such a double-back fold unless the context dictates otherwise.

The way the wipes are folded, that is to say their fold pattern, the quantity of the wetting/cleansing agent and its nature all have an influence on the dispensing of the wipes, i.e. the way the next wipe is drawn to the opening.

The concept of this invention is to provide a stack of wipes with an improved fold pattern. More particularly the concept involves a wipe arrangement in which one wipe is enfolded within another wipe having an enfolding fold. This arrangement enables an enfolded portion of the next wipe to be drawn towards a dispensing aperture due to friction between the enfolded portion of the next wipe and the enfolding fold of the one wipe, when the one wipe is dispensed.

Accordingly in a first aspect of the invention within the concept, there is provided a stack of interleaved wipes, the stack comprising:

- wipes each having:
  - a main panel,
  - two folded panels connected to the main panel by respective creases at respective opposite edges of the main panel and forming respective folds, both folded panels being folded to the same side to the main panel and
  - at least one further folded panel connected to one of the folded panels at a further crease;
- the wipes being interleaved with:
  - the crease at one main panel edge of one wipe being enfolded within an enfolding fold formed by the main panel and the respective folded panel of the next wipe on the side in the stack opposite from the same side and

- the crease at the opposite main panel edge of the one wipe being part of an enfolding fold, having enfolded within it the crease at that edge of the next wipe on the same side.

Please note that the distinction between the enfolding fold and the enfolded fold is important.

Normally, the stack will be oriented for dispensing with the said same side being on the underside of a respective wipe or at least a side facing away from a dispensing aperture in a container of the stack. In this orientation on dispensing of a wipe, the folded panel of the enfolding fold or the further fold connected to it of the wipe being dispensed tends to draw the folded panel of the enfolded fold or the further fold connected to it towards the opening by frictional contact therewith.

Alternatively, with the stack oppositely oriented, on dispensing the folded panel of the enfolded fold or the further fold connected to it of the wipe being dispensed tends to draw the folded panel of the enfolding fold or the further fold connected to it towards the opening by frictional contact therewith.

In either case dispensing does not involve a folded panel, or a further folded panel, acting directly on a main panel, whereby the risk of successive wipes being dispensed in place of a single wipe is ameliorated.

In an arrangement which we refer to as the Modified C Fold, the further folded panel is provided at the edge of the folded panel in the fold at the opposite main panel edge and is folded away from the main panel to lie against the main panel of the next but one wipe on the same side of the main panel. We can envisage the further folded panel could be folded in to lie against the folded panel of the next wipe.

Alternatively, the further panel could be folded in against the main panel of its wipe from the enfolded folded panel or it could be folded out from the enfolding folded panel to lie against the enfolding folded panel.

It can also be envisaged that both folded panels could have a further folded panel each being arranged in any of the above arrangements.

The enfolded crease can extend into the full depth of the enfolding fold or partially so in accordance with the extent of friction required to draw the enfolded wipe to a dispensing aperture.

The enfolded and enfolding folded panels will normally be of the same extent but can be of different extents, again in accordance with the extent of friction required.

Normally the crease of the further folded panel will extend substantially to the middle of the stack, whereby the number of thicknesses of wipe is uniform at substantially all cross-sectional positions. In practice, the crease positions can be set to provide a degree of tolerance in crease position such as to avoid folded panel overlap, with a consequential thick region of the stack. This can result in a minor region where there are fewer thicknesses of wipe.

Accordingly in a second aspect of the invention within the concept, there is provided a stack of interleaved wipes, the stack comprising:

- wipes each having:
  - a main panel,
  - two folded panels connected to the main panel by respective creases at respective opposite edges of the main panel, one of the folded panels being folded to the one side to the main panel and the other to the other and
  - at least one further folded panel connected to one of the folded panels at a further crease;

the wipes being interleaved with:

the crease at one main panel edge of one wipe being part of an enfolding fold, having enfolded within it the crease at that edge of the next wipe on the dispense side of the one wipe and the crease at the opposite main panel edge of the one wipe being part of an enfolded fold, enfolded within an enfolding fold of the wipe on the opposite side of the one wipe.

As in the first aspect, the main panel of the next wipe being drawn to the opening is not acted on, again ameliorating the risk of multiple wipe dispensing.

The folded panel of the enfolded fold can folded to either side of its main panel and the further folded panel, when provided at it can be folded to either side of it. Equally the further panel can be provided at the enfolding folded panel, folded to either side of it.

Again further folded panels can be provided at each folded panel.

Accordingly in a third aspect of the invention within the concept, there is provided a stack of interleaved wipes, the stack comprising:

wipes each having:

a main panel, two folded panels connected to the main panel by respective creases at respective opposite edges of the main panel, one of the folded panels being folded to the one side to the main panel and the other to the other and at least one further folded panel connected to one of the folded panels at a further crease and folded away from its main panel;

the wipes being interleaved with:

a free edge of the further folded panel, remote from the further crease, of one wipe enfolded within the fold of a folded panel and the main panel of the next wipe in the stack and the folded panel of the one panel at the opposite edge enfolding a free edge of the further panel, remote from its further crease, of the next wipe on the other side.

As in the first and second aspects, the main panel of the next wipe being drawn to the opening is not acted on, again ameliorating the risk of multiple wipe dispensing.

The enfolding further panel, enfolding the free edge of the further folded panel of the next wipe, can be plain without its own further folded panel or it can have an infolded or out folded further folded panel.

To help understanding of the invention, several embodiments thereof will now be described by way of example and with reference to the accompanying drawings, in which.

Figure 1:
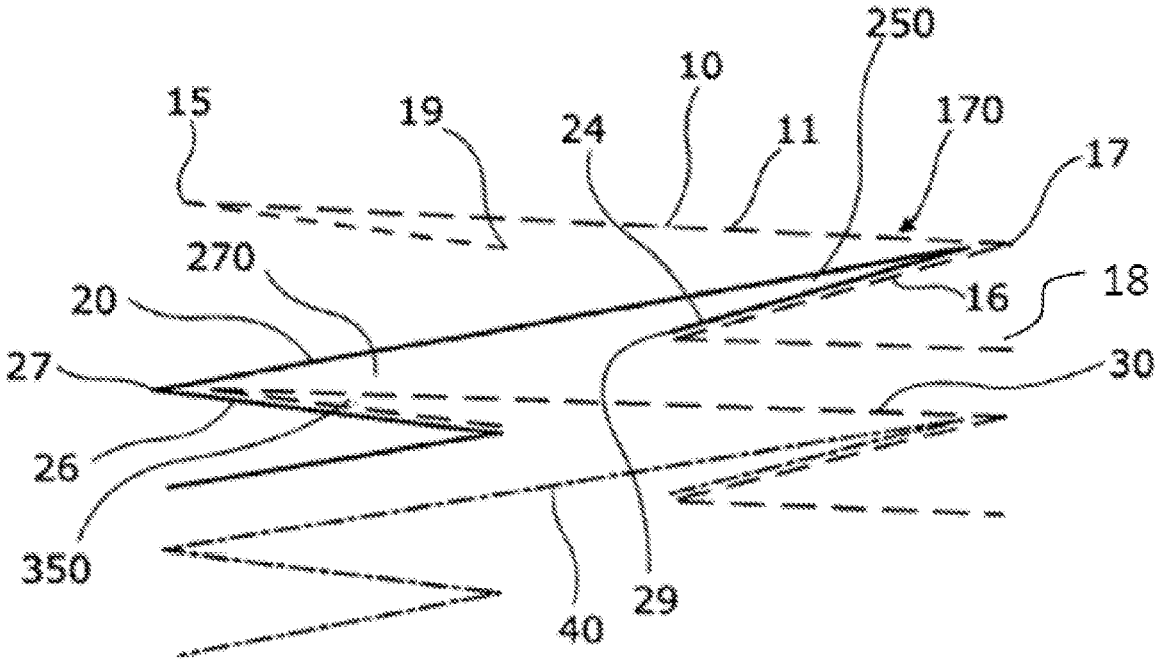
FIG. 1 is a diagrammatic side view of four representative wipes of a stack of a first embodiment in accordance with the invention.
Figure 2:
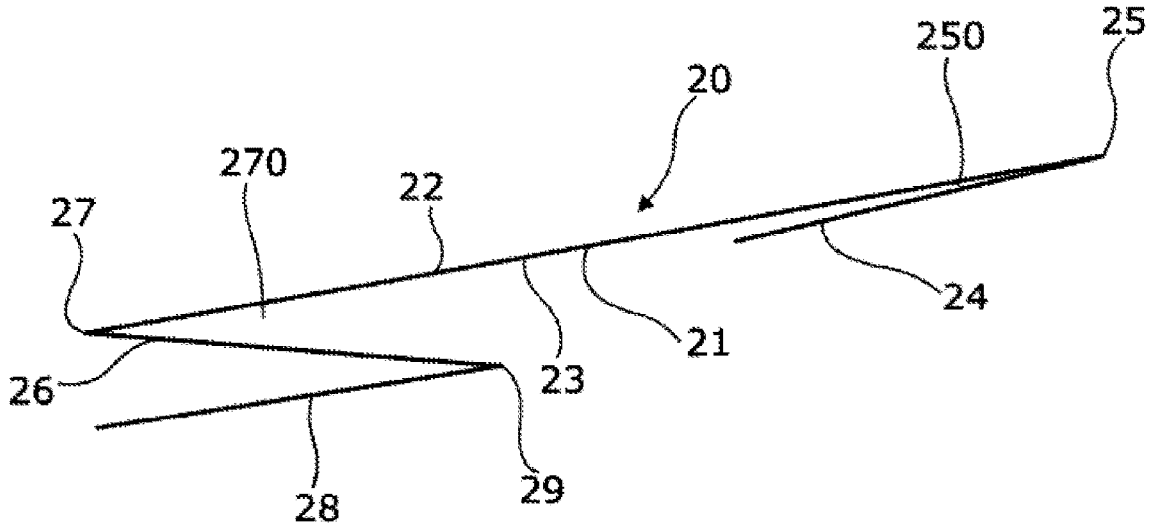
FIG. 2 is a similar view of a single wipe of the four shown in FIG. 1.
Figure 3:
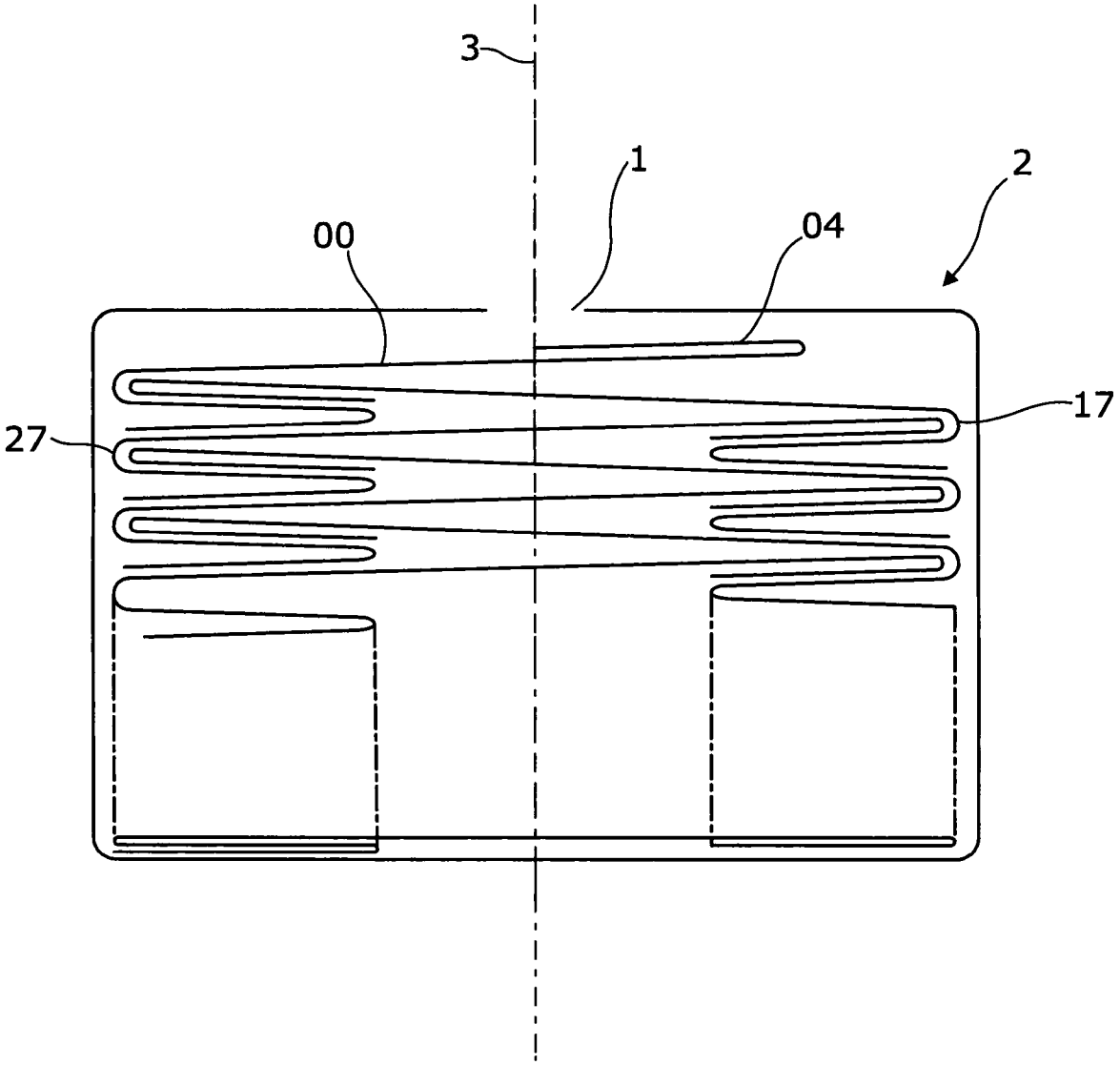
FIG. 3 is a similar diagrammatic side view of the first stack in a container, with a dispensing opening, showing an initial wipe and the four wipes of FIG. 1.

Referring to FIGS. 1 to 3 of the accompanying drawings, four wipes 10, 20 30, 40 are shown in FIG. 1 with wipe 10 dotted, wipe 20 with a full line, wipe 30 dotted and wipe 40 chain dotted for clarity of their folding and interleaving.

The single wipe 20 shown in FIG. 2 has the following features:

a main panel or portion 21 with a first face 22 and a second face 23. When the stack is oriented for dispensing upwards, the first face 22 will be uppermost;

a first folded portion 24 folded from a first crease 25 at one edge of the main portion underneath it, i.e. to the second face side 23;

a second folded panel or portion 26 similarly folded from a second crease 27 at an opposite edge of the main portion underneath the main portion, whereby both the first and the second portions would lie against the same face 23, if it were not for the interleaving shown in FIG. 1; and a further folded panel or portion 28 folded from the second folded portion at a further crease 29, which is at the edge of the second folded portion opposite from its second crease 27, and is at the proximal edge of the further folded portion 28. This portion lies underneath the second folded portion.

It should be noted that in folding one portion with respect to another at a crease, a generally U-shaped or V-shaped arrangement of the panels is created which can enfold another portion of the same wipe or another wipe. This arrangement is referred to as a fold with the numeral of the crease in the fold followed by the suffix 0. So the fold formed by the main and first folded portions 21,24 with the crease 25 is referred to as fold 250.

The first and second folded portions 24,26, both being on the same side of the main portion 21 form have a general C configuration, not contributed to by the further folded portion 28. This gives rise to the folded arrangement of the wipes, that is their fold pattern, being referred to as a Modified C fold.

Referring to FIG. 1, the interleaving of the wipes will be described with reference to the wipe 20. In practice, as shown in FIG. 3, the first wipe 10 will have its first crease 15 drawn to the region of or partially through an opening 1 in a container 2 of the wipes, so that it can be grasped and drawn through the opening. The second wipe 20 and those below are in their interleaved arrangement.

The crease 25 together with adjoining parts of the portions 21,24, is enfolded in a fold 170 of the wipe 10 formed by its portions 11,16 and the crease 17. The wipe 10 is the wipe next to the wipe 20 on its side opposite from its portions 24,26.

The crease 27 at the opposite edge from crease 25 of the main portion 21 forms with the main portion 21 and the second folded portion 26 a fold 270 which enfolds the fold 350 of the wipe 30. Thus the wipes are interleaved for successive dispensing of the wipes one after the other.

On dispensing of the wipe 10, by drawing it through the opening 1 of the container 2, the folded portion 16 of the enfolding fold 170 of the wipe 10 tends to draw the folded portion 24 of the enfolded fold 250 towards the opening by frictional contact therewith. It should be noted that the frictional contact is not with the main portion 21. As such there is more opportunity for the wipe 20 to be held back and the for the portion 16 to break away from the portion 24 and avoid dispensing of the wipe 20 as well as the wipe 10 as the latter is withdrawn through the opening. This effect is believed to be helped by the further folded portion 18 being folded against the portion 16.

It will be appreciated that the very first wipe in a Modified C fold stack does not present a convenient edge to be grasped for dispensing. For this reason, as show in FIG. 3, a slightly differently folded initial wipe 00 is provided with its folded portion 04 oppositely folded to present its free, distal edge at the opening. This wipe is folded into a W format.

Because there are three thicknesses of each wipe on one side of the centreline 3 of the container and two on the other, the total width of the pack, and hence its shelf footprint, is reduced—compared with two and two conventional thicknesses.

Figure 4:
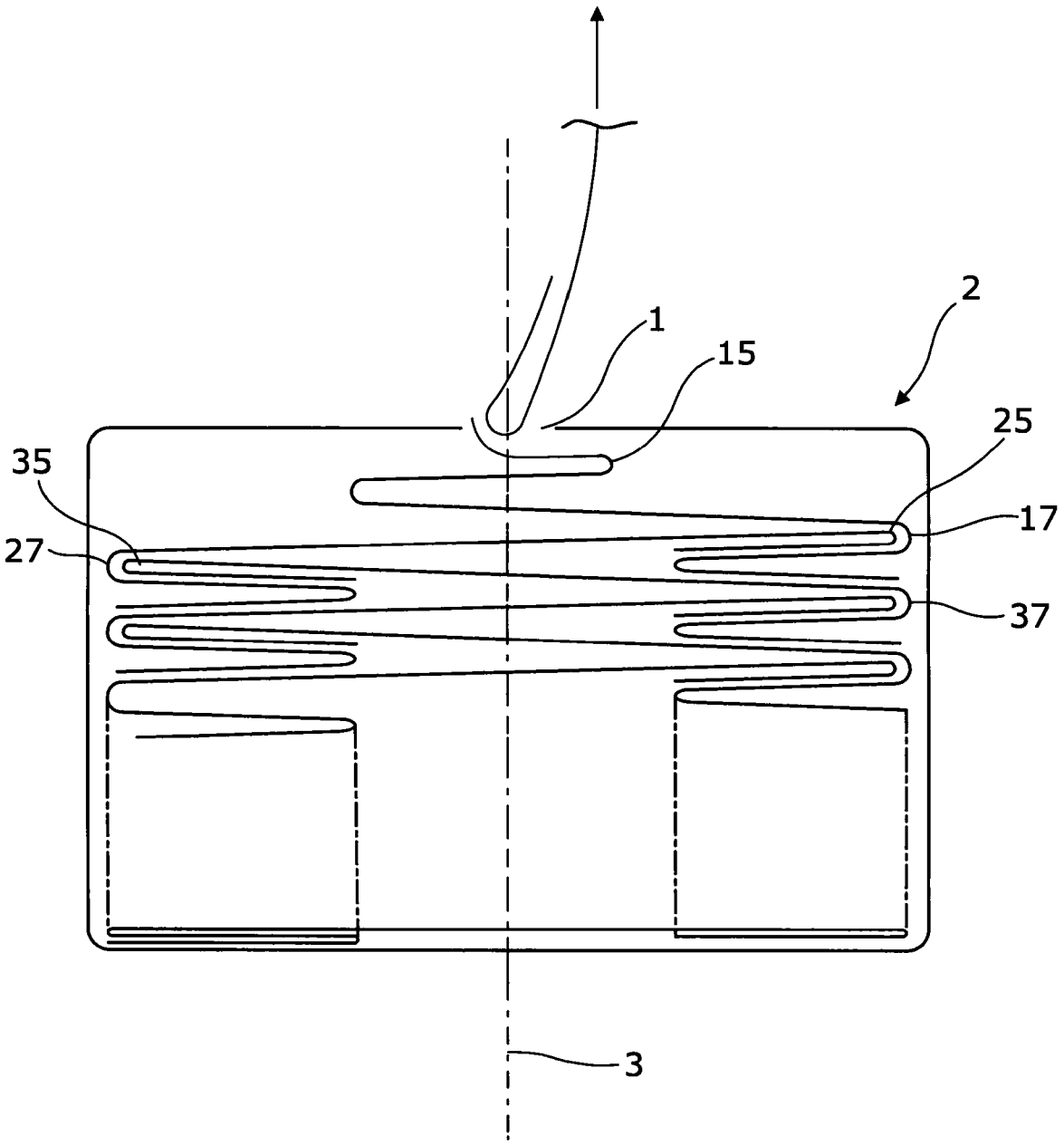
FIG. 4 is a further similar view, showing the initial wipe close to complete withdrawal and the first of the wipes of FIG. 1 being drawn to an opening of the container.

In practical terms, the free edges of the first folded portions and creases 19,29, etc. do not extend fully to the centreline, to avoid tolerance build up causing a ridge in the middle of the stack. Rather these edges and portions are kept a short distance from the centreline. Further as shown in FIG. 4, the enfolded creases 25,35, etc. can be spaced inwards from the enfolding creases 17,27, etc. to enable the parameters of the interleaving to be adjusted to suit such factors known to the skilled reader such as variation in inter-wipe friction caused by variations in the compositions with which the wipes are impregnated.

Conveniently the stack is manufactured by introducing a pre-fold at creases 19,29, etc. into each web prior to their folding at creases 15,17,25,27, etc., and their interleaving. The operation of a web processing machine to perform these operations will be within the capabilities of the skilled person and will not be described further.

Further the most common form of container for wet wipes is a flow-wrap pack. In manufacture, the seal is made with the pack inverted and the opening downwards the pre-fold will normally be made upwards with the stacks and flow-wrap packs being inverted, at least before use.

Figure 5:
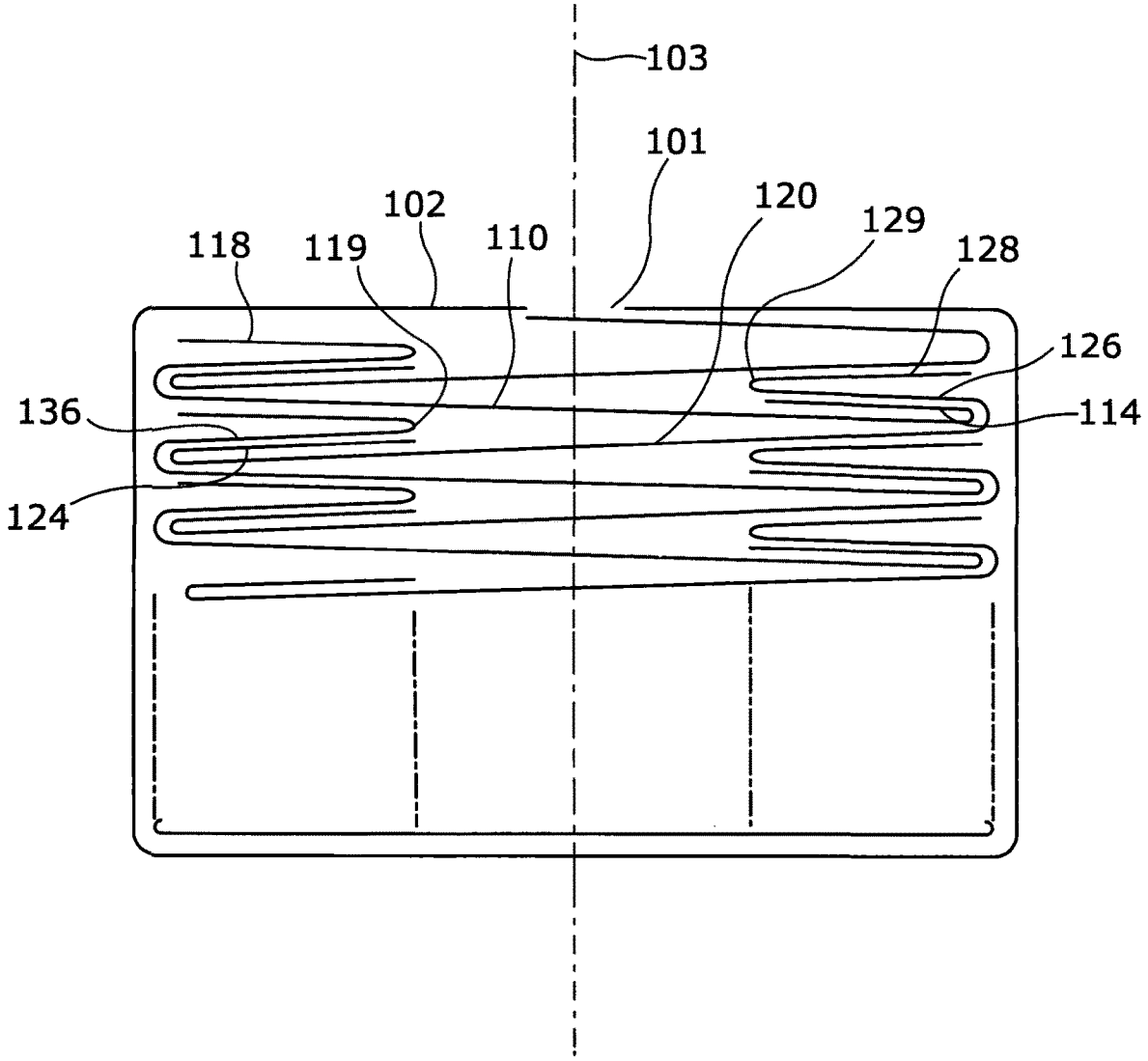
FIG. 5 is side view of an inverted variant of the container and wipes of FIG. 3, with the wipes of the stack inverted.

Alternatively as shown in FIG. 5, where corresponding features are given the same reference numeral prefixed with 1 the stack can be oppositely oriented. With the pre-fold further folds 118,119 etc. being folded down prior to stack inversion to the use orientation shown in FIG. 5.

The dispensing operation is different in this instance. The folded portions 114,124, etc abut beneath the portions 126, 136 etc. The creases 119, 129 etc. are already presented close to the opening 102 and little drawing through the opening is required. This fold pattern, known as the Inverted Modified C is suitable where very low inter-wipe friction exists.

In either case dispensing does not involve a folded panel, or a further folded panel, acting directly on a main panel, whereby the risk of successive wipes being dispensed in place of a single wipe is ameliorated.

Figure 6:
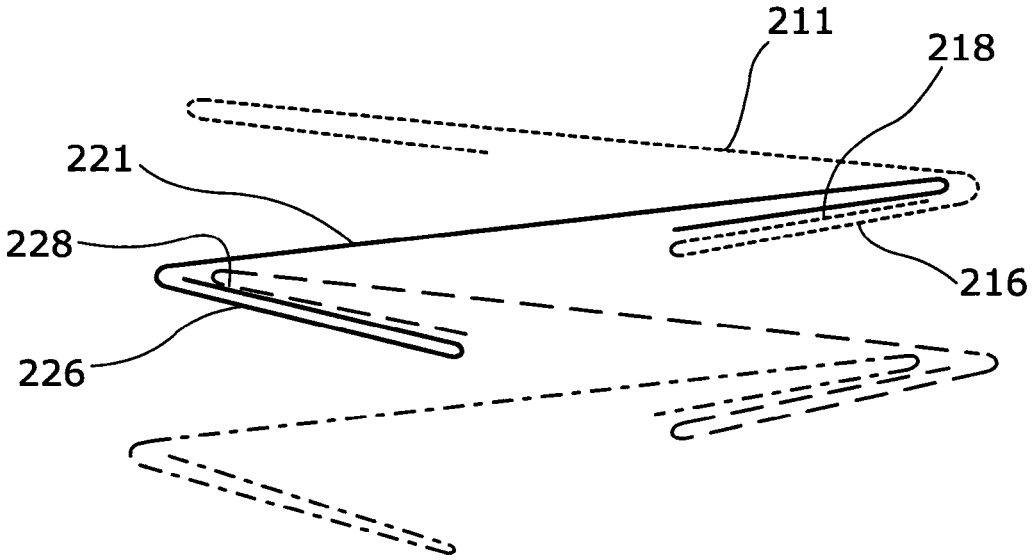
FIG. 6 is a view similar to FIG. 1 of four interleaved wipes with a variation in their folding.

In the both the Modified C and Inverted Modified C folds, portions 11,16,18, etc., 21,26,28, etc.; 111,116,118 etc., 121,126,128 etc. these portion are folded in a Z format. These could be folded in with a C format as shown in FIG. 6 in respect of a variant of the Modified C fold. The portions concerned are 211,216,218, etc., 221,226,228, etc. The further folded portions 218,228 are folded between the main portions 211,221 and folded portions 216,226.

Figure 7:
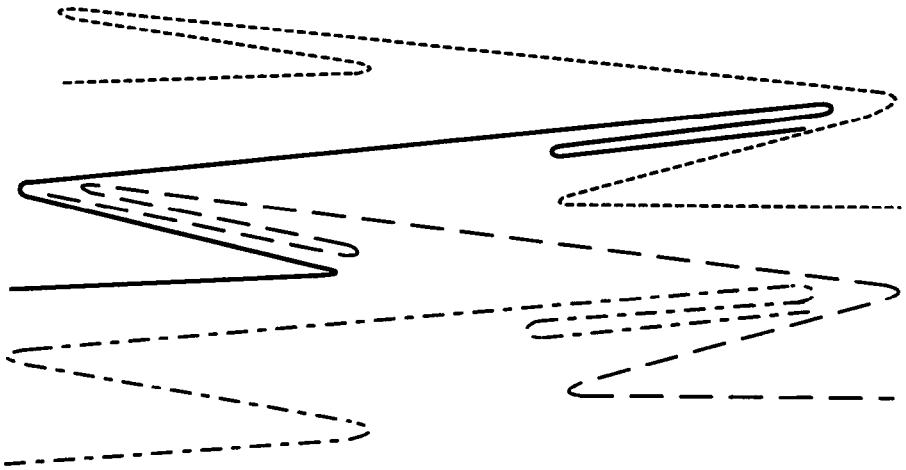
FIG. 7 is another view similar to FIG. 1 of four interleaved wipes with another variation in their folding.

Equally other variants are possible as shown in FIG. 7, which is a Modified C fold with Z folded or out-folded "further folded portions" on both "folded portions". In a non-illustrated variant, the further folded portions could be in- or C-folded.

Figure 8:
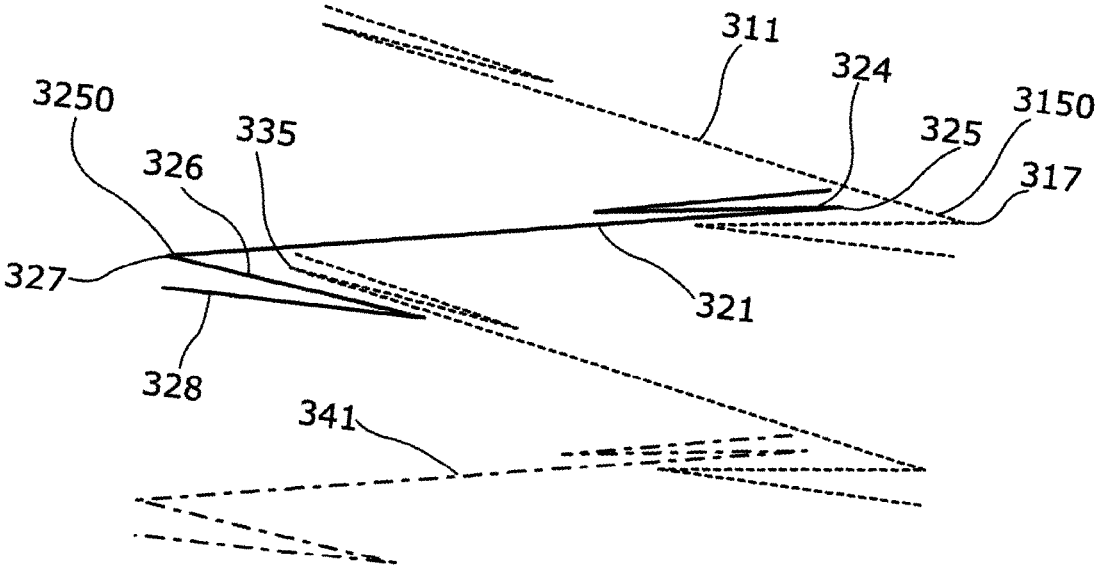
FIG. 8 is a diagrammatic side view similar to FIG. 1 of four representative wipes of a stack of a second embodiment in accordance with the invention.
Figure 9:
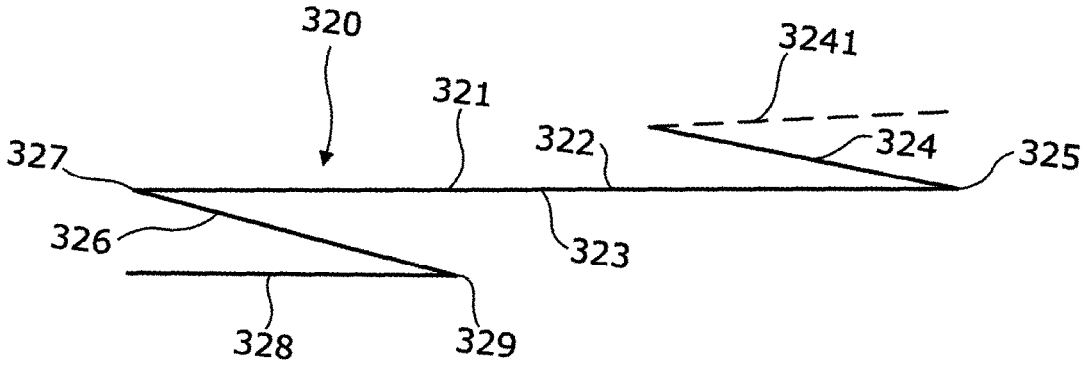
FIG. 9 is a similar view of a single wipe of the four shown in FIG. 8.

Turning now to FIGS. 8 and 9, another interleaved wipe stack embodying the inventive concept of narrow width and improved dispensing is shown. One 320 of the wipes of this stack has:

- a main panel or portion 321 with a first face 322 and a second face 323. When the stack is oriented for dispensing upwards, the first face 322 will be uppermost;
- a first folded portion 324 folded from a first crease 325 at one edge of the main portion over it, i.e. to the first face side 322;
- a second folded panel or portion 326 similarly folded from a second crease 327 at an opposite edge of the main portion underneath the main portion, i.e. to the opposite, second face side 323 of the main panel; and
- a further folded panel or portion 328 folded from the second folded portion at a further crease 329, which is at the edge of the second folded portion opposite from its second crease 327, and is at the proximal edge of the further folded portion 328. This portion lies underneath the second folded portion, with the wipe being folded into a W format.

The wipes of this stack are interleaved as follows:

- the first crease 325 of the wipe 320 together with its first folded and further folded portions 324,3241 is enfolded in the enfolding fold 3150 of the next wipe in the dispensing direction, at its crease 317;
- The second crease 327 is part of an enfolding fold 3250 around the first crease 335 of the previous wipe in the dispensing direction, with the second folded portion 326, or the further folded portion 328, extending against the main portion 341 of the wipe below.

During dispensing, as in the first embodiment, the main panel of the next wipe being drawn to the opening is not acted on, again ameliorating the risk of multiple wipe dispensing.

A variant is indicated in FIG. 9, whereby the first folded portion has a W-folded further folded portion 3241. Again the further folded portion 3241 could be provided in place of the further folded portion 328.

Other variants are possible whereby the or each further folded portion is in-folded as opposed to being out-folded.

Figure 10:
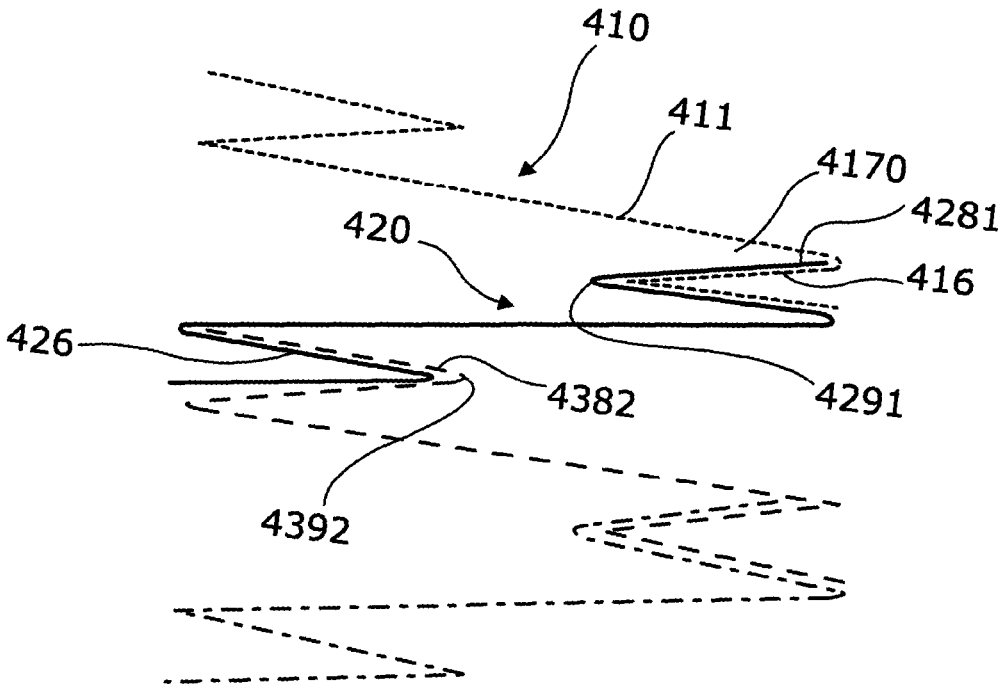
FIG. 10 is a diagrammatic side view similar to FIG. 1 of four representative wipes of a stack of a third embodiment in accordance with the invention.
Figure 11:
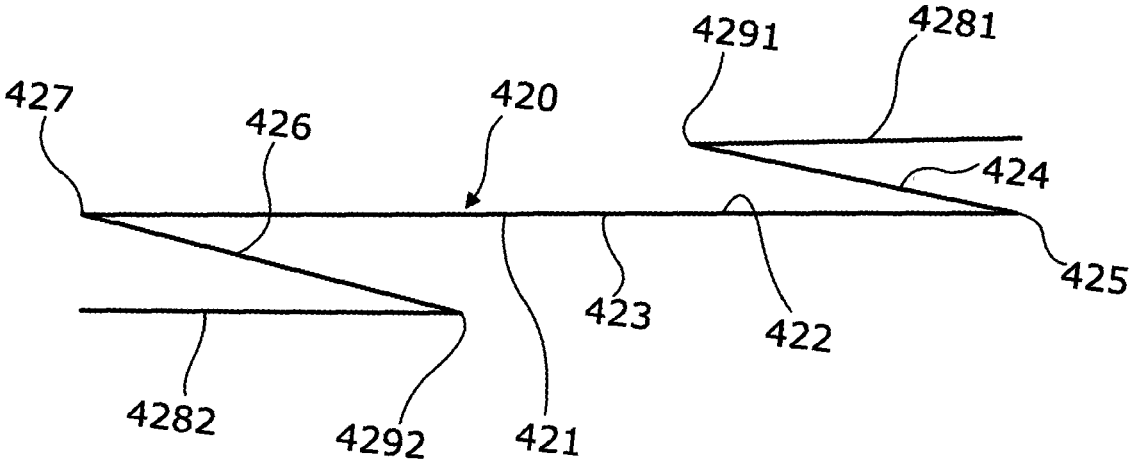
FIG. 11 is a similar view of a single wipe of the four shown in FIG. 10.

Turning now to FIGS. 10 and 11, a third interleaved wipe stack embodying the inventive concept of narrow width and improved dispensing is shown. One 420 of the wipes of this stack has:

- a main panel or portion 421 with a first face 422 and a second face 423. When the stack is oriented for dispensing upwards, the first face 422 will be uppermost;
- a first folded portion 424 folded from a first crease 425 at one edge of the main portion over it, i.e. to the first face side 422;
- a second folded panel or portion 426 similarly folded from a second crease 427 at an opposite edge of the main portion underneath the main portion, i.e. to the opposite, second face side 423 of the main panel;
- a first further folded panel or portion 4281 folded from the first folded portion at a first further crease 4291, which is at the edge of the first folded portion opposite from its first crease 425, and is at the proximal edge of the further folded portion 4281. This portion lies over the first folded portion; and a second further folded panel or portion 4282 folded from the second folded portion at a further crease 4292, which is at the edge of the second folded portion opposite from its second crease 427, and is at the proximal edge of the further folded portion 4282. This portion lies underneath the second folded portion. Thus the wipe is folded into a W format with an extra limb.

It will be noted that this wipe is in fact folded in the same manner as the variant wipe of FIG. 9. However the manner of interleaving as follows is quite different.

The wipes of this stack are interleaved as follows:

the free, distal edge of the first further folded portion 4281, remote from the first further crease 4291, of the wipe 420 is enfolded within the fold 4170 of a folded portion 416 and the main portion 411 of the next wipe 410 in the dispensing direction and;

the folded panel 426 of the wipe 420 at the opposite edge enfolding a free edge of the second further panel 4382, remote from its further crease 4392, of the next wipe 430.

On withdrawal to the wipe above the enfolded further folded portion is drawn to the opening of the stack's container by the enfolding fold.

As in the first and second embodiments, the main panel of the next wipe being drawn to the opening is not acted on, again ameliorating the risk of multiple wipe dispensing.

The enfolding further panel, enfolding the free edge of the further folded panel of the next wipe, can be plain without its own further folded panel or it can have an infolded or out folded further folded panel.

Figure 12:
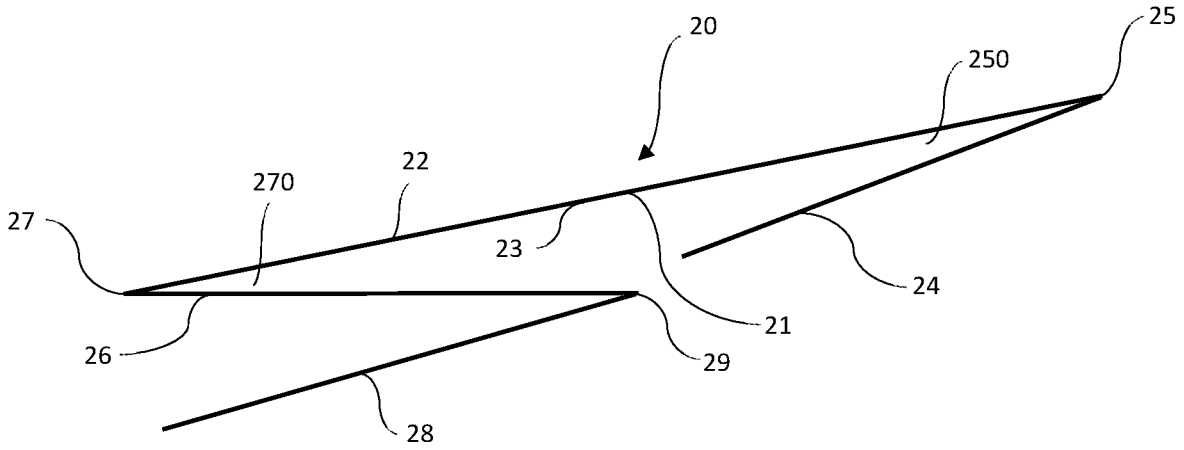
FIG. 12 is a similar view of a single wipe of the four shown in FIG. 1.

As shown in FIG. 12, in this embodiment, the crease of the further folded panel will extend substantially to the middle of the stack.

The invention claimed is:

1. A stack of interleaved wipes, the stack comprising:

wipes each having:

a main panel having two opposite faces on respective opposite facing sides of the main panel and two opposite creased edges, one being an enfolding one and the other being an enfolded one, at least three folded panels, wherein a first and a second folded panels connected to the main panel by respective creases at respective opposite creased edges, of the main panel and forming respective folds, both folded panels being folded to a same face side of the main panel and a third folded panel connected to the first or the second folded panel at a further crease;

the wipes being stacked and interleaved, whereby a second wipe has:

the enfolded creased edge of the second wipe enfolded within an enfolding fold formed by the main panel and the respective folded panel of a first wipe opposite from the said same face side of the second wipe and the enfolding creased edge of the second wipe being part of an enfolding fold, formed by the main panel and the respective folded panel of the second wipe, and having enfolded within it the enfolded creased edge of a third wipe on the same face side of the second wipe, wherein the crease of the third folded panel extends towards a middle of the stack, whereby a thickness of the stack is substantially uniform at all cross-sectional positions.

2. A stack of interleaved wipes as claimed in claim 1, wherein the stack is oriented for dispensing with the said same face side:

being on the underside of a respective wipe, or facing away from a dispensing aperture in a container of the stack.

3. A stack of interleaved wipes as claimed in claim 1, wherein the folded panel of the enfolding fold, or the further fold connected to it, of the wipe being dispensed is arranged such as to tend to draw the folded panel of the enfolded fold or the further fold connected to it towards the opening by frictional contact therewith.

4. A stack of interleaved wipes as claimed in claim 1, wherein the enfolded crease extends into a full depth of the enfolding fold to draw the wipe with said enfolded crease to a dispensing aperture.

5. A stack of interleaved wipes as claimed in claim 1, wherein the crease positions are configured to provide a space in crease position to avoid folded panel overlap.

6. A stack of interleaved wipes as claimed in claim 1, wherein the third folded panel connected to one of the folded panels at a further crease is folded:

away from the main panel to lie against the main panel of the next but one wipe in the direction of the same face of the main panel.

7. A stack of interleaved wipes as claimed in claim 1, wherein the third folded panel connected to one of the folded panels at a further crease is folded:

in to lie against the main panel of its wipe from the enfolded folded panel.

* * * * *